US009121155B2

(12) United States Patent
Foo et al.

(10) Patent No.: US 9,121,155 B2
(45) Date of Patent: Sep. 1, 2015

(54) ICE RESISTANT JACKUP LEG

(71) Applicants: Keppel Offshore & Marine Technology Centre Pte Ltd, Singapore (SG); ConocoPhillips Company, Houston, TX (US)

(72) Inventors: Kok Seng Foo, Singapore (SG); Michael John Perry, Singapore (SG); Cynthia Wang, Singapore (SG); Matthew Quah Chin Kau, Singapore (SG); Randall Scott Shafer, Houston, TX (US); Peter Noble, Houston, TX (US)

(73) Assignees: Keppel Offshore & Marine Technology Centre Pte Ltd, Singapore (SG); ConocoPhillips Company

( * ) Notice: Subject to any disclaimer, the term of this patent is extended or adjusted under 35 U.S.C. 154(b) by 67 days.

(21) Appl. No.: 14/033,507

(22) Filed: Sep. 22, 2013

(65) Prior Publication Data

US 2014/0086690 A1 Mar. 27, 2014

Related U.S. Application Data

(60) Provisional application No. 61/704,560, filed on Sep. 24, 2012.

(51) Int. Cl.

| | |
|---|---|
| ***E02B 17/02*** | (2006.01) |
| ***E02B 17/00*** | (2006.01) |
| ***E02B 17/08*** | (2006.01) |

(52) U.S. Cl.

CPC ..... *E02B 17/0021* (2013.01); *E02B 17/021* (2013.01); *E02B 17/0818* (2013.01); *E02B 17/0836* (2013.01)

(58) Field of Classification Search

USPC ..... 405/195.1, 196, 197, 203, 204, 205, 405/217

See application file for complete search history.

(56) References Cited

U.S. PATENT DOCUMENTS 3,823,563 A * 7/1974 Lovie ..... 405/224
4,269,543 A 5/1981 Goldman et al.

(Continued)

FOREIGN PATENT DOCUMENTS

GB 2081139 A 2/1982
WO WO2012/054808 A1 4/2012

OTHER PUBLICATIONS

International Search Report and Written Opinion of international application No. PCT/SG2013/000416 completed and mailed Nov. 13, 2013 (10 pages).

*Primary Examiner* — Benjamin Fiorello
*Assistant Examiner* — Kyle Armstrong
(74) *Attorney, Agent, or Firm* — Pyprus Pte Ltd

(57) ABSTRACT

The present invention provides an the ice resistant Jackup leg that comprises a plurality of chords, a plurality of plate structures, wherein the chords and plate structures are alternatively positioned so that the plate structures connect the chords to form the peripheral structure of the ice resistant Jackup leg, a plurality of longitudinal stiffeners, wherein the longitudinal stiffeners are disposed onto the inner surface of the plate structures for stiffening the plate structures, and a plurality of traverse web frames or girders, wherein the traverse web frames or girders are disposed onto the inner surface of the plate structures for supporting the plurality of longitudinal stiffeners. The present invention also provides an ice resistant Jackup platform employing the ice resistant Jackup leg.

10 Claims, 7 Drawing Sheets

(56) References Cited

U.S. PATENT DOCUMENTS

| | | | | |
|---|---|---|---|---|
| 4,388,024 | A * | 6/1983 | Dysarz | 405/198 |
| 4,969,776 | A * | 11/1990 | Bunce et al. | 405/203 |
| 7,594,781 | B1 | 9/2009 | Sanders | |
| 2006/0070568 | A1 * | 4/2006 | Converse et al. | 114/355 |
| 2007/0107184 | A1 | 5/2007 | Cardamone et al. | |
| 2010/0040418 | A1 * | 2/2010 | Wishahy et al. | 405/227 |
| 2010/0329796 | A1 * | 12/2010 | Burns et al. | 405/211 |
| 2012/0128429 | A1 * | 5/2012 | Noble et al. | 405/196 |

* cited by examiner

ICE RESISTANT JACKUP LEG

RELATED APPLICATION

This application claims the benefit under 35 U.S.C. 119(e) of U.S. Provisional Application Ser. No. 61/704,560 titled with "Ice Resistant Jackup Leg", filed Sep. 24, 2012 which is herein incorporated by reference.

FIELD OF THE INVENTION

The present invention relates generally to the technology of offshore platforms, and more particularly to a jackup leg intended for operation in areas subject to sea ice.

BACKGROUND OF THE INVENTION

Conventional Jackup Drilling units are well known in the oil and gas industry as a solution for drilling in shallow water. Smaller Jackups often use tubular structures as legs whereas larger jackups tend to use truss legs consisting of chords, interconnected with braces. The Jackup concept and the issues discussed here would apply equally to both drilling and production units.

Conventional jackup units are intended only for operation in climates subject to little or no sea ice. While tubular legs could theoretically be sized up such that the shell is able to resist local ice pressures, it would be difficult to be incorporated with powerful leg jacking and holding systems that would be required for the large weights and ice loads expected. A conventional truss leg on the other hand is very good at transferring global loads and incorporating a powerful leg jacking and holding system, however the leg members are not designed for local loading from ice and could only resist reasonably small ice loads. Simply scaling the brace members could increase the local member strength but the increase could not be significant enough to make this an attractive option. The truss leg has an additional disadvantage that ice may accumulate inside the leg, resulting in increased ice loads. It has also been suggested that Jackup legs could be protected by the attachment of additional structures such as cones or plating. These additional structures may have to be installed on site and are likely very heavy, resulting in significant installation costs.

Structures presently used in areas subject to sea ice are generally large stiffened plate structures, consisting of shell plating, supported by a grillage of stiffeners and girders. These structures are effective in resisting ice loads, but are very large and not usually able to be moved easily from one location to another.

SUMMARY OF THE INVENTION

One aspect of the present invention provides an ice resistant Jackup leg for being employed in a Jackup offshore platform. In one embodiment, the ice resistant Jackup leg comprises a plurality of chords, a plurality of plate structures, wherein the chords and plate structures are alternatively positioned so that the plate structures connect the chords to form the peripheral structure of the ice resistant Jackup leg, a plurality of longitudinal stiffeners, wherein the longitudinal stiffeners arc disposed onto the inner surface of the plate structures for stiffening the plate structures, and a plurality of traverse web frames or girders, wherein the traverse web frames or girders are disposed onto the inner surface of the plate structures for supporting the plurality of longitudinal stiffeners.

In another embodiment of the ice resistant Jackup leg, the plurality of chords are three, and the plurality of plate structures are three, so that the ice resistant Jackup leg has a cross triangular configuration.

In another embodiment of the ice resistant Jackup leg, the plurality of chords are four, and the plurality of plate structures are four, so that the ice resistant Jackup leg has a cross square configuration.

In another embodiment of the ice resistant Jackup leg, each of the plurality of chords has a triangular configuration and comprises a thick rack plate with teeth to allow for jacking using a rack and pinion jacking system, and two connecting plates of which each is connected to one end of one plate structure.

In another embodiment of the ice resistant Jackup leg, each of the plurality of chords has a split tubular configuration and comprises a thick rack plate with teeth for jacking and two semi-cylindrical members welded onto either side of the thick rack plate.

Another aspect of the present invention provides an ice resistant Jackup platform. In one embodiment, the ice resistant Jackup platform comprises a hull, a plurality of ice resistant Jackup legs passing through the hull, a plurality of jackcase structures, wherein each of the plurality of jackcase structures is equipped to each of the plurality of ice resistant Jackup legs to provide connection between the hull and the legs, and a plurality of spudcans, wherein each of the plurality of spudcans is connected to the bottom of each of the plurality of ice resistant Jackup legs to provide footing on seabed; wherein each of the plurality of ice resistant Jackup legs comprises a plurality of chords, a plurality of plate structures, wherein the chords and plate structures are alternatively positioned so that the plate structures connect the chords to form the peripheral structure of the ice resistant Jackup leg, a plurality of longitudinal stiffeners, wherein the longitudinal stiffeners are disposed onto the inner surface of the plate structures for stiffening the plate structures, and a plurality of traverse web frames or girders, wherein the traverse web frames or girders are disposed onto the inner surface of the plate structures for supporting the plurality of longitudinal stiffeners.

The ice resistant Jackup leg of the present invention comprises chords and plated structures. The chords provide a cross sectional area at specific locations around the leg in order to efficiently transfer global loads along the leg and through the leg-hull connection. The plated structures provide local strength to resist large ice loads and also act as "web" structures to transfer shear loads between the chords. A certain portion of the plating will also be effective in increasing the chord cross section.

The present invention combines the local strength characteristics of a stiffened plate structure, with the global performance and load transfer capabilities of a truss leg, allowing a Jackup structure to operate in areas subject to sea ice. In addition, as the plating structure is an integral part of the leg it does not require any additional time or cost for installation offshore. The plating structure also serves the dual purpose of resisting local ice pressures and providing a means for shear transfer between the chords, eliminating the need of traditional bracing.

The objectives and advantages of the invention will become apparent from the following detailed description of preferred embodiments thereof in connection with the accompanying drawings.

BRIEF DESCRIPTION OF THE DRAWINGS

Preferred embodiments according to the present invention will now be described with reference to the Figures, in which like reference numerals denote like elements.

DETAILED DESCRIPTION OF THE INVENTION

The present invention may be understood more readily by reference to the following detailed description of certain embodiments of the invention.

Throughout this application, where publications are referenced, the disclosures of these publications are hereby incorporated by reference, in their entireties, into this application in order to more fully describe the state of art to which this invention pertains.

The present invention provides a Jackup leg with capacity of resisting ice loads when used in a Jackup platform to be installed in areas subject to sea ice. Briefly, the Jackup leg comprises a plurality of chords and plate structures connecting the chords, where the plate structures are stiffened or strengthened by a plurality of longitudinal stiffeners and a plurality of traverse web frames or girders. The number of the chords in a Jackup leg usually depends on the cross-sectional configuration of the Jackup leg; for example, the Jackup leg has 3 or 4 chords in a triangular or square configuration respectively, where each chord is positioned at each corner. Accordingly, the Jackup leg comprising a larger number of chords, or with other shapes could be created using a similar approach. In addition, the chords could be positioned at a location other than a corner.

Figure 1:
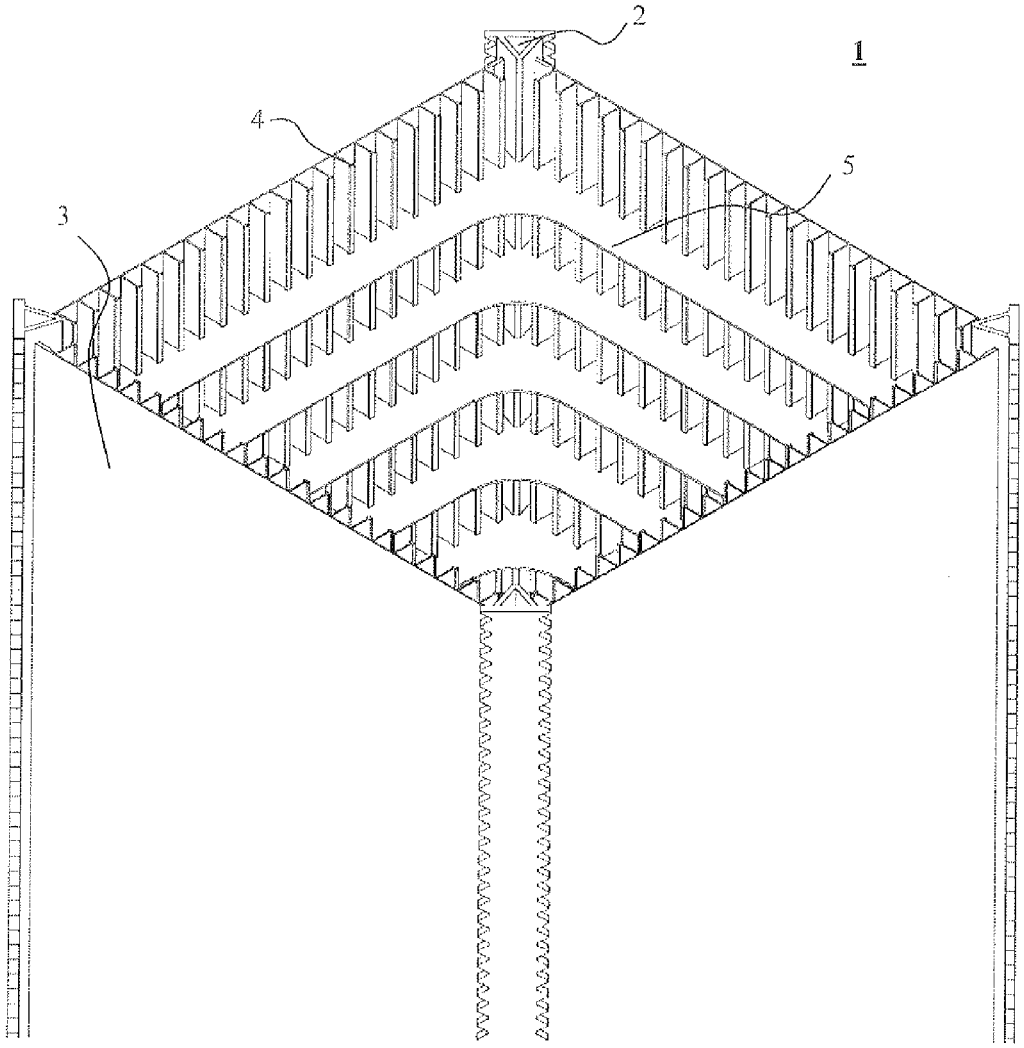
FIG 1. shows an isometric view of a portion of the ice resistant Jackup leg in accordance with one embodiment of the present invention.
Figure 2:
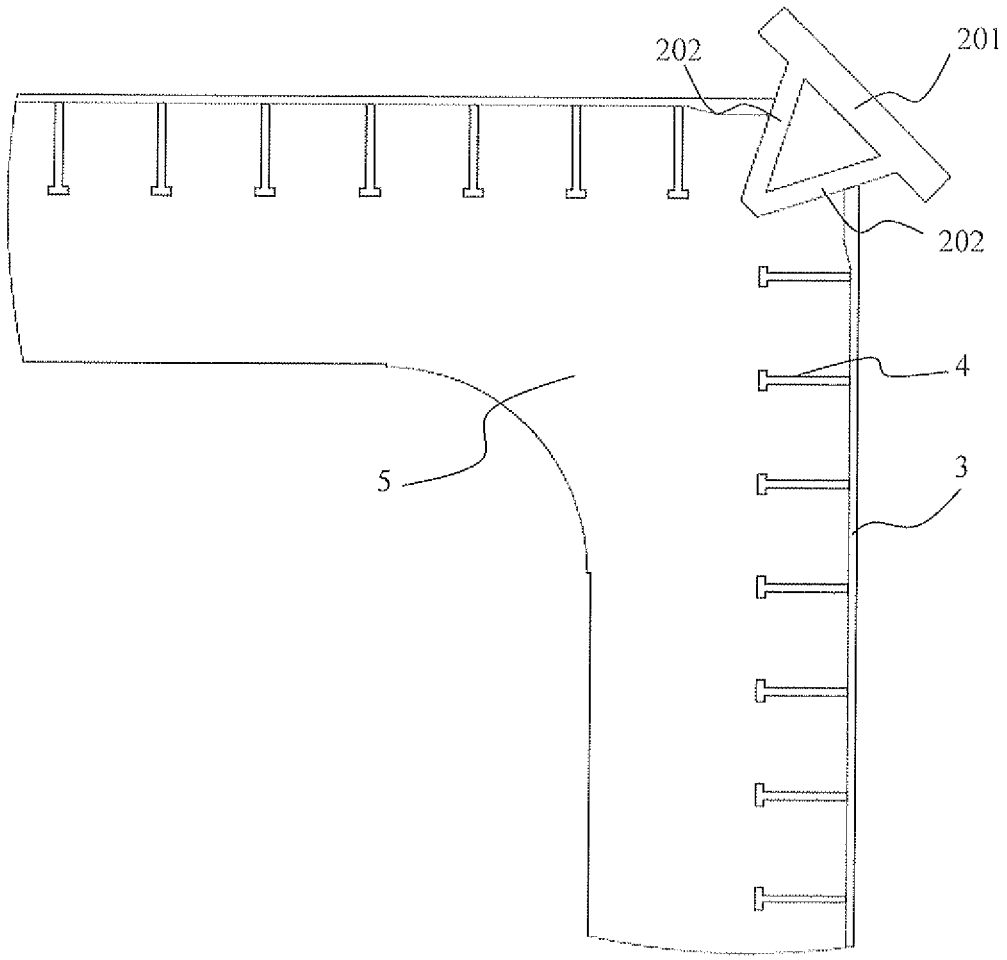
FIG. 2 shows a partial sectional view of the ice resistant Jackup leg in accordance with one embodiment of the present invention.

Referring now to FIG. 1, there is provided an isometric view of a portion of the ice resistant Jackup leg in accordance with one embodiment of the present invention. As shown in FIG. 1, the ice resistant Jackup leg 1 has a square configuration, and comprises four chords 2 of which each is positioned at one corner, four plate structures 3 connecting the four chords 2, a plurality of longitudinal stiffeners 4 disposed onto the inner surface of the four plate structures 3 for stiffening the four plate structures 3, and a plurality of traverse web frames or girders 5 disposed onto the inner surface of the four plate structures 3 for supporting the plurality of longitudinal stiffeners 4. FIG. 2 shows a partial cross sectional view of the ice resistant Jackup leg 1. In the embodiment of FIGS. 1 and 2, the chord 2 has a triangular configuration and comprises a thick rack plate 201 with teeth to allow for jacking using a rack and pinion jacking system, and two connecting plates 202 of which each is connected to one end of one plate structure 3. In FIG. 1, for the purpose of clarity, the girders 5 are illustrated as simple plate structures. It is recognized however that in other embodiments the girders are likely to be fitted with flange plates in order to increase their strength. The connections between the chords, plates, stiffeners and girders would generally be welded; however depending on the materials, other methods such as bolting, or a combination of fastening methods could also be used. The ice resistant Jackup leg 1 is preferably made from steel. In certain embodiments, the plate structures and/or stiffeners could be made from the sandwich plate consisting of steel-polymer-steel or steel-concrete-steel. In certain embodiments, the ice resistant Jackup leg 1 is assembled by preparing sections of each of the plate structures and then welding these to the chords to complete a leg section, and the plate structures could be prepared by first welding stiffeners to the plate and then welding the girders or web frames to the plate and stiffeners in a transverse direction. Several leg sections could then be installed, one above another and welded together in order to build up the complete leg.

Figure 3:
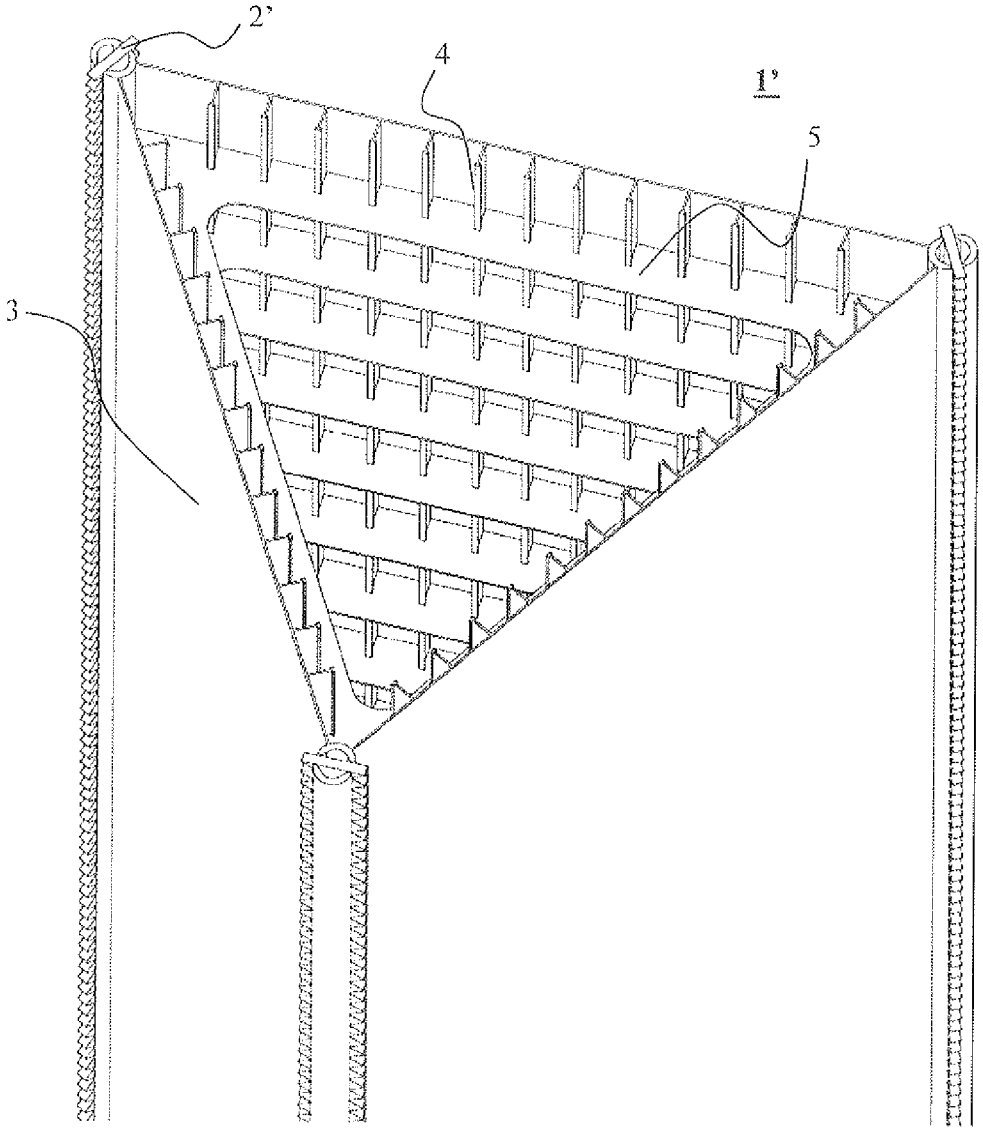
FIG. 3 shows an isometric view of a portion of the ice resistant Jackup leg in accordance with another embodiment of the present invention.

Referring now to FIG. 3, there is an isometric view of the ice resistant Jackup leg in accordance with another embodiment of the present invention. As shown in FIG. 3, the ice resistant Jackup leg 1' comprises three chords 2' in a triangular arrangement, three plate structures 3 connecting the chords 2', a plurality of longitudinal stiffeners 4 disposed onto the inner surface of the three plate structures 3 for stiffening the three plate structures 3, and a plurality of traverse web frames or girders 5 disposed onto the inner surface of the three plate structures 3 for supporting the plurality of longitudinal stiffeners 4. The chord 2' is shown as a "split tubular" type chord, comprising a thick rack plate with teeth for jacking and two semi-cylindrical members welded onto either side of the thick rack plate. It is to be noted that other chord types and chord arrangements are possible and covered by the present invention.

Figure 4:
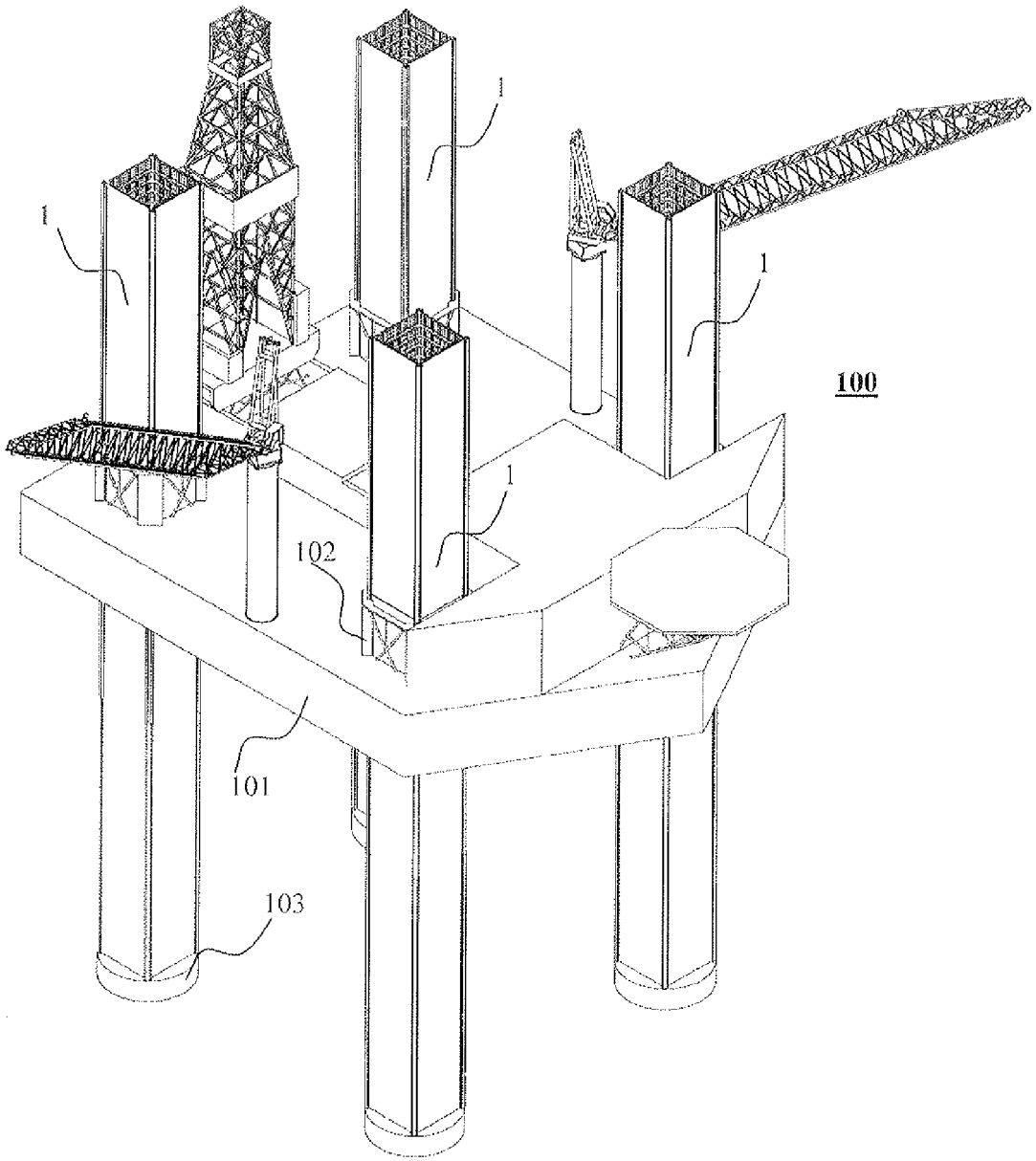
FIG. 4 shows an isometric view of an ice resistant Jackup platform incorporating a plurality of the ice resistant Jackup legs in accordance with one embodiment of the present invention.
Figure 5:
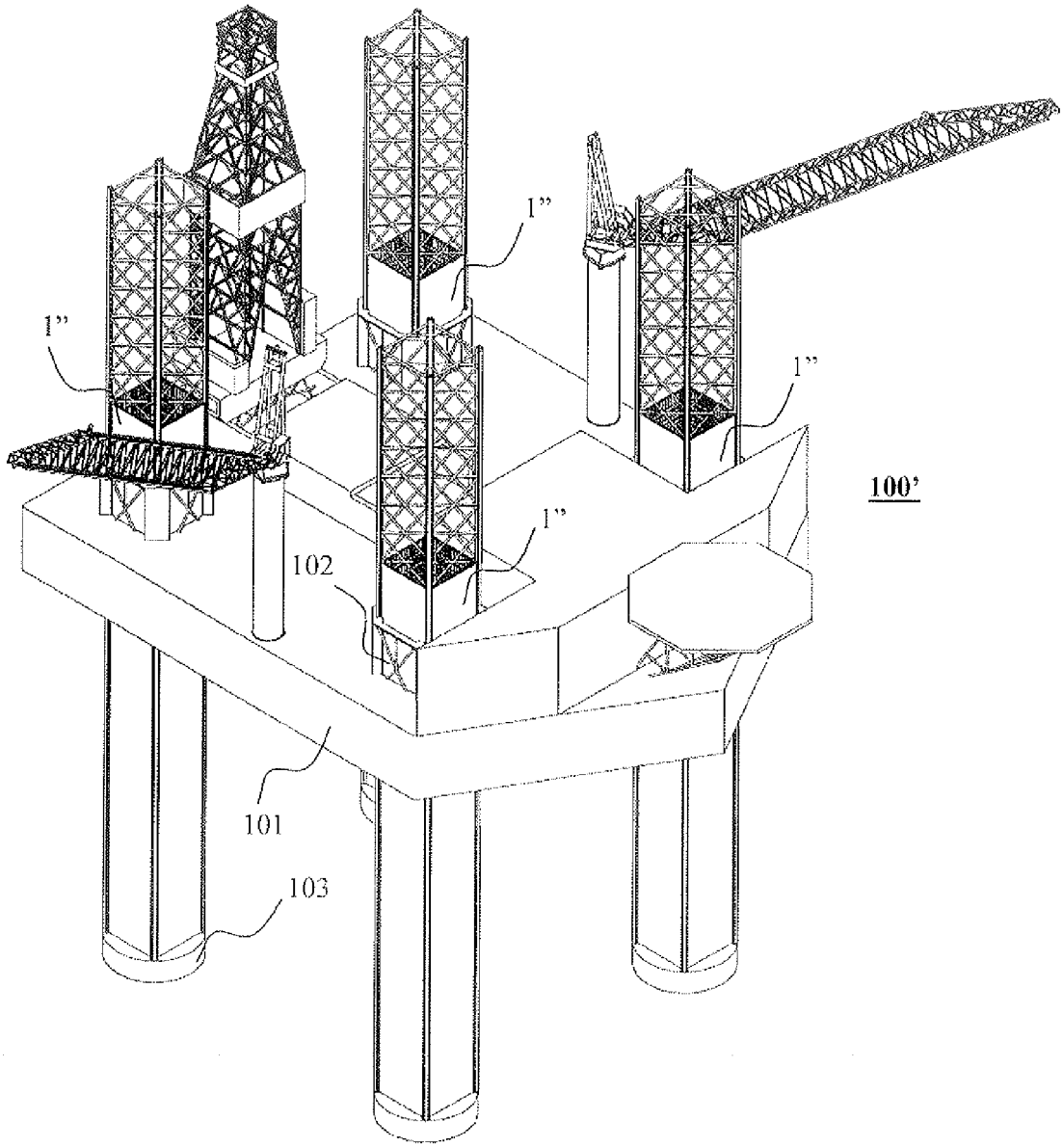
FIG. 5 shows an isometric view of an ice resistant Jackup platform incorporating a plurality of the ice resistant Jackup legs in accordance with another embodiment of the present invention.

Referring now to FIG. 4, there is provided an isometric view of an ice resistant Jackup platform incorporating a plurality of the ice resistant Jackup legs in accordance with one embodiment of the present invention. It is to be noted that the arrangement of the ice resistant Jackup drilling units may vary with different designs. As shown in FIG. 4, the ice resistant Jackup platform 100 comprises a hull 101, a plurality of ice resistant Jackup legs 1 as shown in FIG. 1 passing through the hull 101, a plurality of jackcase structures 102 of which each is equipped to one ice resistant Jackup leg 1 to provide connection between the hull 101 and the legs 1, and a plurality of spudcans 103 of which each is connected to the bottom of one ice resistant jackup leg 1 to provide footing on the seabed. In FIG. 4 the ice resistant Jackup legs are provided over the full height of the legs, from the spudcan to the top of the leg; however, in other applications, it would be expected that the ice resistant portion of the leg could be restricted to a portion of the leg, with a truss type leg provided over the remainder of the leg as illustrated in FIG. 5. In this case, the ice resistant Jackup platform 100' comprises four ice resistant Jackup legs 1" of which each contains a portion of the ice resistant leg that is used over the lower part of the leg and a portion of the truss leg that is provided in the upper part of the leg. This arrangement is beneficial, for example, if the jackup is intended to resist ice in shallow water, but still operate in ice free regions in deeper water. It also allows a lighter leg structure to be used above the ice region if the jackup is operating with a significant height of the hull above the water level. It is to be appreciated that the ice resistant leg could also be applied in other configurations, for example, with a portion of truss leg near the spudcan, a central ice resistant portion and then a truss leg again provided at the upper part. The jackups shown in FIGS. 4 and 5 are intended for drilling; however the ice resistant Jackup leg could similarly be incorporated into jackup units intended for other purposes such as accommodation and production.

The ice resistant Jackup leg with the stiffened plate structures is able to withstand large ice forces and to transfer the load to the chords. The stiffened plate structures also act to brace the chords, providing the shear transfer necessary for the global transfer of loads along the legs down to the foundation or upwards to the leg-hull connection.

Figure 6:
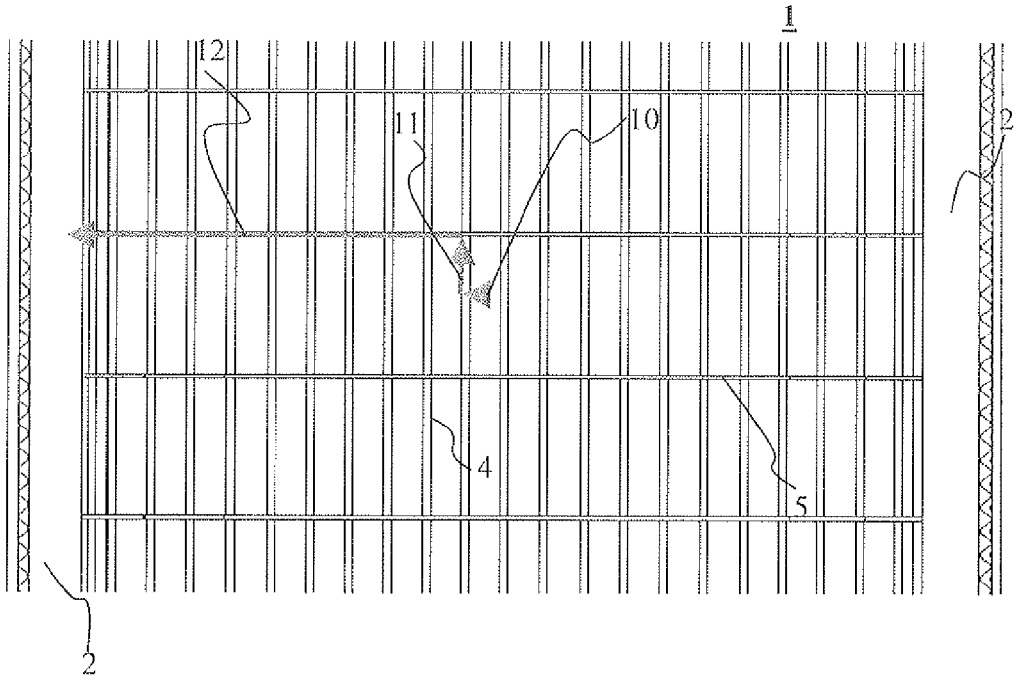
FIG. 6 shows an exemplary illustration of local load transfers achieved by the ice resistant Jackup leg of the present invention.
Figure 7:
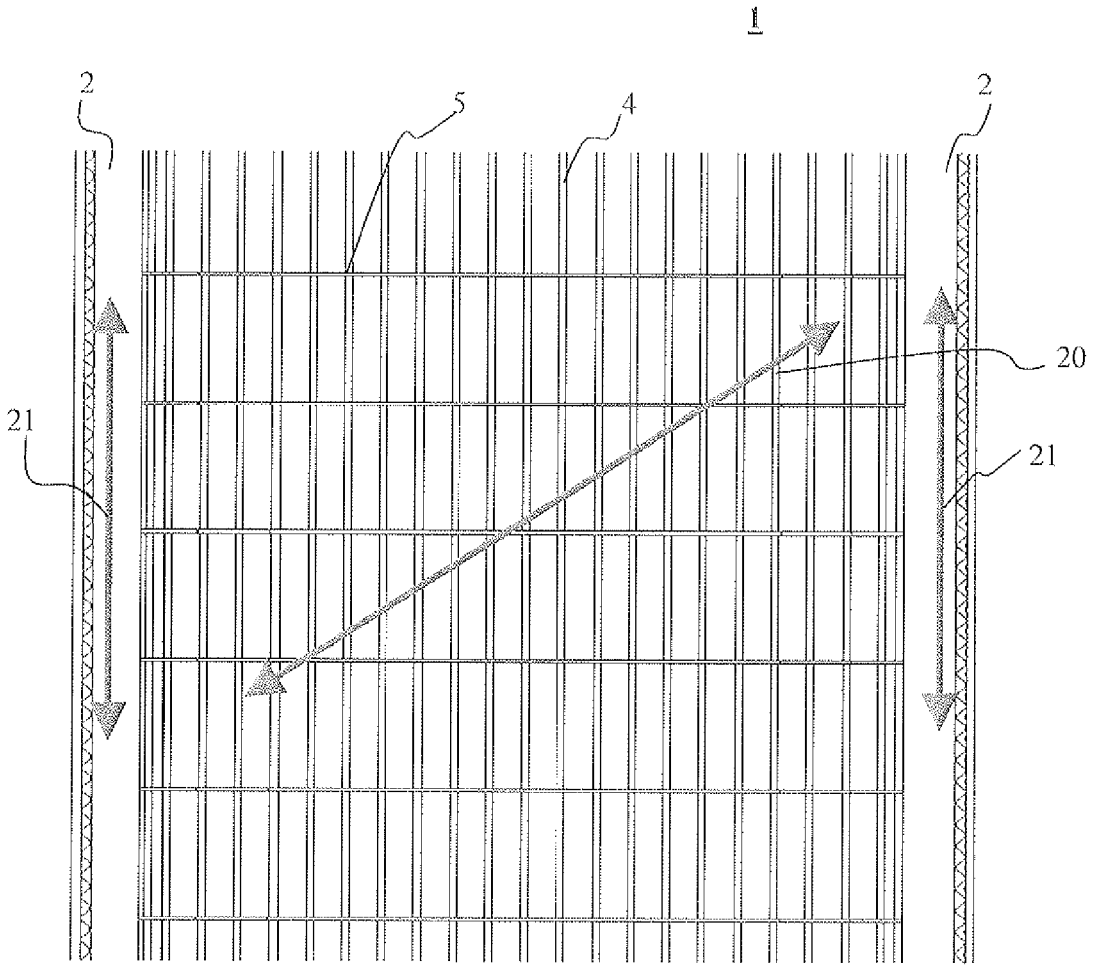
FIG. 7 shows an exemplary illustration of global load transfers achieved by the ice resistant Jackup leg of the present invention.

Referring now to FIGS. 6 and 7, there are provided schematic views of one face of the ice resistant leg illustrating the load transfers of the ice resistant Jackup leg in accordance with the present invention. The ice resistant Jackup leg is designed for both local and global load transfers. As shown in FIG. 6, the stiffened plate structures allow local loads to be transferred via the paths 10, 11, 12 towards the chords 2. That is, loads due to ice applied on the plate structure will be transferred by the plating along path 10 to the longitudinal stiffeners 4 and subsequently along path 11 to the traverse web frames or girders 5, and then carried out along path 12 to the corners of the leg to be carried by the chords 2. As shown in FIG. 7, global loads are transferred primarily by the chords 2, along the directions 21 in the same way as a conventional truss leg, whereby the chord area and large separation of the chords creates a cross section area and modulus that is able to carry the global axial loads and leg bending moments. Global shear transfer, which would normally be transferred by leg bracing in a truss leg, can be transferred through the outer plating, such as shown by arrow 20, removing the need to provide additional leg bracing.

In one embodiment, the Jackup leg may have a chord to chord spacing of about 40 feet, with chord cross sectional areas of 500 square inches, outer plate thickness of about 1.5 inches and stiffeners and girders ranging from a several inches to several feet. It should be recognized that, depending on the design conditions, the example dimensions provided in this document could vary quite widely, but the concept of chords, or concentrated areas of cross section area, interconnected by a stiffened plate arrangement would be preserved.

While the present invention has been described with reference to particular embodiments, it will be understood that the embodiments are illustrative and that the invention scope is not so limited. Alternative embodiments of the present invention will become apparent to those having ordinary skill in the art to which the present invention pertains. Such alternate embodiments are considered to be encompassed within the scope of the present invention. Accordingly, the scope of the present invention is defined by the appended claims and is supported by the foregoing description.

What is claimed is:

1. An ice resistant jackup leg for being employed in a jackup offshore platform, comprising:

a plurality of chords;

a plurality of outer plate structures, wherein the chords and outer plate structures are alternatively positioned so that the outer plate structures connect the chords to form an enclosed structure of the ice resistant jackup leg throughout the portion of the leg in contact with water and ice;

a plurality of longitudinal stiffeners, wherein the longitudinal stiffeners are disposed onto the inner surface of the outer plate structures for stiffening the outer plate structures; and a plurality of traverse web frames or girders, wherein the traverse web frames or girders are disposed onto the inner surface of the outer plate structures for supporting the plurality of longitudinal stiffeners.

2. The ice resistant jackup leg of claim 1, wherein the plurality of chords are three, and the plurality of outer plate structures are three, so that the ice resistant jackup leg has a cross triangular configuration.

3. The ice resistant jackup leg of claim 1, wherein the plurality of chords are four, and the plurality of outer plate structures are four, so that the ice resistant jackup leg has a cross square configuration.

4. The ice resistant jackup leg of claim 1, wherein each of the plurality of chords has a triangular configuration and comprises a thick rack plate with teeth to allow for jacking using a rack and pinion jacking system, and two connecting plates of which each is connected to one end of one outer plate structure.

5. The ice resistant jackup leg of claim 1, wherein each of the plurality of chords has a split tubular configuration and comprises a thick rack plate with teeth for jacking and two semi-cylindrical members welded onto either side of the thick rack plate.

6. An ice resistant jackup platform, comprising:

a hull;

a plurality of ice resistant jackup legs passing through the hull;

a plurality of jackcase structures, wherein each of the plurality of jackcase structures is equipped to each of the plurality of ice resistant jackup legs to provide connection between the hull and the legs; and a plurality of spudcans, wherein each of the plurality of spudcans is connected to the bottom of each of the plurality of ice resistant jackup legs to provide footing on seabed;

wherein each of the plurality of ice resistant jackup legs comprises:

a plurality of chords;

a plurality of outer plate structures, wherein the chords and outer plate structures are alternatively positioned so that the outer plate structures connect the chords to form an enclosed structure of the ice resistant jackup leg throughout the portion of the leg in contact with water and ice;

a plurality of longitudinal stiffeners, wherein the longitudinal stiffeners are disposed onto the inner surface of the outer plate structures for stiffening the outer plate structures; and a plurality of traverse web frames or girders, wherein the traverse web frames or girders are disposed onto the inner surface of the outer plate structures for supporting the plurality of longitudinal stiffeners.

7. The ice resistant jackup platform of claim 6, wherein the plurality of chords are three, and the plurality of outer plate structures are three, so that the ice resistant jackup leg has a cross triangular configuration.

8. The ice resistant jackup platform of claim 6, wherein the plurality of chords are four, and the plurality of outer plate structures are four, so that the ice resistant jackup leg has a cross square configuration.

9. The ice resistant jackup platform of claim 6, wherein each of the plurality of chords has a triangular configuration and comprises a thick rack plate with teeth to allow for jacking using a rack and pinion jacking system, and two connecting plates of which each is connected to one end of one outer plate structure.

10. The ice resistant jackup platform of claim 6, wherein each of the plurality of chords has a split tubular configuration and comprises a thick rack plate with teeth for jacking and two semi-cylindrical members welded onto either side of the thick rack plate.

* * * * *